US009370217B2

(12) United States Patent
Arai

(10) Patent No.: US 9,370,217 B2
(45) Date of Patent: Jun. 21, 2016

(54) HELMET

(71) Applicant: Michio Arai, Saitama-ken (JP)

(72) Inventor: Michio Arai, Saitama-ken (JP)

( * ) Notice: Subject to any disclaimer, the term of this patent is extended or adjusted under 35 U.S.C. 154(b) by 0 days.

(21) Appl. No.: 14/546,647

(22) Filed: Nov. 18, 2014

(65) Prior Publication Data

US 2015/0135411 A1 May 21, 2015

(30) Foreign Application Priority Data

Nov. 19, 2013 (JP) ..... 2013-238921

(51) Int. Cl.
*A42B 3/00* (2006.01)
*A42B 3/28* (2006.01)

(52) U.S. Cl.
CPC ..... *A42B 3/283* (2013.01)

(58) Field of Classification Search
CPC ..... A42B 3/281; A42B 3/283
USPC ..... 2/410
See application file for complete search history.

(56) References Cited

U.S. PATENT DOCUMENTS 3,496,854 A * 2/1970 Hill ..... A42B 3/28 2/410
4,575,875 A * 3/1986 Dawson ..... A42B 3/227 2/10
5,086,520 A * 2/1992 Arai ..... A42B 3/283 2/171.3
5,093,937 A * 3/1992 Kamata ..... A42B 3/283 2/171.3
5,517,698 A * 5/1996 Nault ..... A42B 3/066 2/424
5,734,994 A * 4/1998 Rogers ..... A42B 3/281 2/411
5,855,404 A * 1/1999 Saunders ..... B62J 17/04 296/180.1
5,996,128 A * 12/1999 Yanagihara ..... A42B 3/281 2/422
6,061,834 A * 5/2000 Liao ..... A42B 3/283 2/171.3
6,105,172 A * 8/2000 Shida ..... A42B 3/24 2/171.3
6,263,513 B1 * 7/2001 Murakami ..... A42B 3/0493 2/171.3
6,425,143 B1 * 7/2002 Benedict ..... A42B 3/281 2/171.3
6,973,676 B1 * 12/2005 Simpson ..... A42B 3/288 128/201.24
7,413,506 B2 * 8/2008 Arai ..... A42B 3/283 2/171.3
7,574,754 B2 * 8/2009 Arai ..... A42B 3/0493 2/410
7,748,059 B2 * 7/2010 Arai ..... A42B 3/0493 2/171.3
2004/0158914 A1 * 8/2004 Tanaka ..... A42B 3/283 2/410
2005/0066416 A1 * 3/2005 Ma ..... A42B 3/283 2/171.3
2006/0248631 A1 * 11/2006 Arai ..... A42B 3/0493 2/424
2007/0050894 A1 * 3/2007 Tsurumi ..... A42B 3/283 2/413
2007/0113318 A1 * 5/2007 Weston ..... A42B 3/281 2/171.3
2007/0192942 A1 * 8/2007 Ahn ..... A42B 3/283 2/410
2008/0201813 A1 * 8/2008 Yang ..... A42B 3/281 2/7

FOREIGN PATENT DOCUMENTS

EP 0650673 5/1995
JP 1053915 2/1998

OTHER PUBLICATIONS

English Abstract of JP 1053915.

* cited by examiner

*Primary Examiner* — Richale Quinn
(74) *Attorney, Agent, or Firm* — Dykema Gossett PLLC

(57) ABSTRACT

A ventilation duct comprises a left duct part and a right duct part which are arranged respectively on the left and right of a shell, and a central duct part which is arranged between the left and right duct parts. The left and right duct parts are held by limiting the movement thereof in the front/rear direction and the left/right direction of the shell, and in a direction away from the shell, by engaging support members, which are set at the arrangement positions of the left and right duct parts on an outer surface of the shell, and by the central duct part.

8 Claims, 7 Drawing Sheets

HELMET

TECHNICAL FIELD

The present invention relates to a helmet which is worn by a driver riding on a moving apparatus, such as a motorcycle or automobile, and more particularly, to a helmet having a function for ventilating the interior of the helmet.

BACKGROUND ART

There is a known helmet having a function for ventilating the interior of the helmet, which has a ventilation duct provided on an outer surface of a shell constituting the outermost layer of the helmet, so as to cover ventilating holes provided to pass through between the inner surface of the helmet and the outer surface, and so as to guide air circulated through the ventilating holes.

The ventilation duct disclosed in Patent Document 1 indicated below is provided with two left and right rear duct parts which are arranged on the rear side of the shell, and a front duct part which is arranged so as to connect the rear duct parts with the front side of the shell, and the rear duct parts and the front duct part are integrally formed.

PRIOR ART DOCUMENTS

Patent Document

[Patent Document 1] Japanese Published Patent Application No. H10-53915

SUMMARY OF THE INVENTION

Technical Problem

The positions of the ventilating holes are set to the positions yielding the highest ventilation efficiency, and the ventilation duct which covers the ventilating holes is formed to a size capable of covering the ventilating holes at an optimal position, so as not to reduce the ventilation efficiency of the ventilating holes.

The ventilating holes are positioned so that the distance between the ventilating holes on the left and right sides of the shell varies with the particular size of the helmet, and therefore it is necessary to prepare a ventilation duct which is capable of covering the ventilating holes at an optimal position, for each different size of helmet.

In other words, there has been a problem in that it has been necessary to manufacture moldings corresponding to each size of ventilation duct, and to manage components for ventilation ducts of different sizes, and this has involved various costs for the manufacture of a helmet.

The present invention addresses the issue of resolving a problem of this kind. In other words, an object of the present invention is to be able to achieve a ventilation duct which is capable of efficient ventilation using the same members, to be able to reduce the manufacturing costs of a helmet having a ventilation duct, to enable accurate installation of a ventilation duct on an outer surface of the shell, without reducing the ventilation efficiency of the ventilating holes, and thereby to enable inexpensive manufacture of a helmet capable of performing efficient ventilation, and the like, regardless of the size of the helmet.

Solution to Problem

In order to achieve this object, the helmet according to the present invention includes at least the following composition.

A helmet comprising, on an outer surface of a shell constituting an outermost layer of the helmet, a ventilation duct which covers ventilating holes provided so as to pass through between an inner surface of the helmet and the outer surface and which guides air circulated through the ventilating holes; wherein the ventilation duct comprises a left duct part and a right duct part arranged respectively on the left and right sides of the shell, and a central duct part arranged between the left duct part and the right duct part; the left duct part and the right duct part have a structure in which the left duct part and the right duct part are held by engaging support members arranged at positions of the left duct part and the right duct part on the outer surface of the shell, and by the central duct part; the engaging support members each comprise a first engaging support part and a second engaging support part; the first engaging support part prevents detachment of the left duct part and the right duct part from the outer surface of the shell towards an outer side in a thickness direction of the shell, and also limits at least one of movement in a front direction and movement in a rear direction of the left duct part and the right duct part on the outer surface, and the second engaging support part limits at least one of movement in a left direction and movement in a right direction of the left duct part and the right duct part on the outer surface; the left duct part and the right duct part each comprise a first engaging part which engages with the first engaging support part, a second engaging part which engages with the second engaging support part, and an insertion portion which is inserted into an insertion opening provided in each of left and right side portions of the central duct part; and the central duct part, by being fixed to the outer surface via an installation part in a state where the insertion portions have been inserted into the insertion openings, keeps the insertion portions in the inserted state by the insertion openings and the outer surface, as well as holding the engaged state of the first engaging parts and the engaged state of the second engaging parts of the left duct part and the right duct part, and the installed state of the central duct part on the outer surface, and thereby fixing the left duct part and the right duct part to the outer surface.

DESCRIPTION OF EMBODIMENTS

Figure 1:
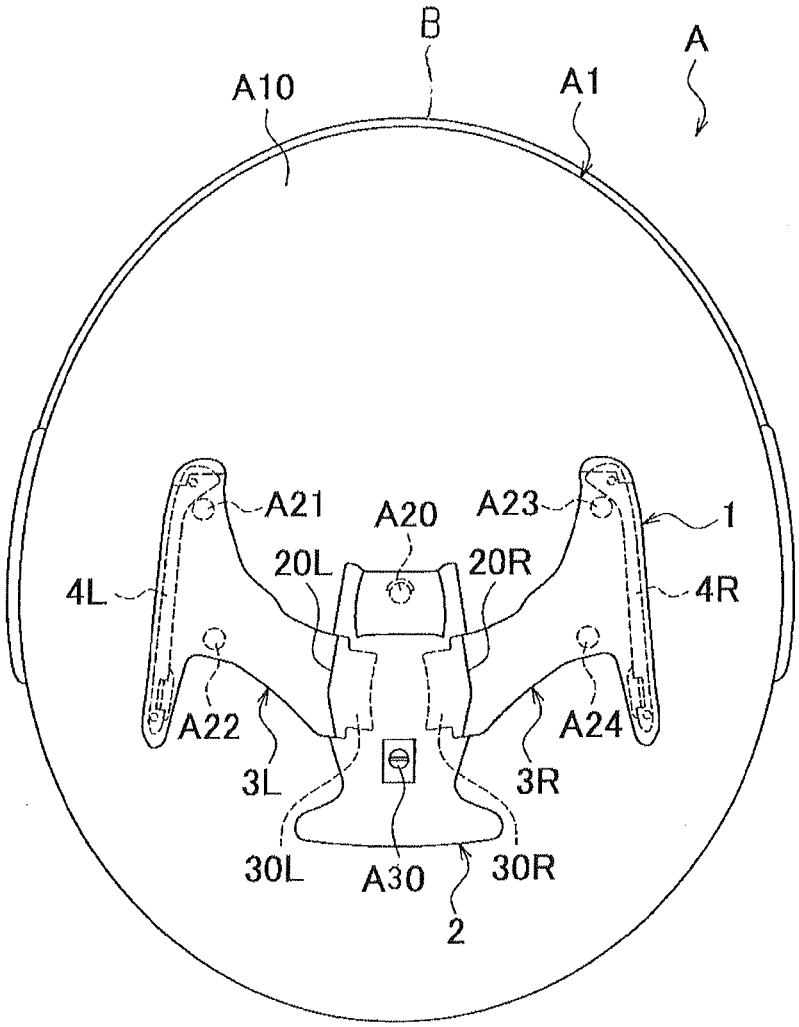
FIG. 1 is a plan diagram showing a helmet according to one embodiment of the present invention.
Figure 2:
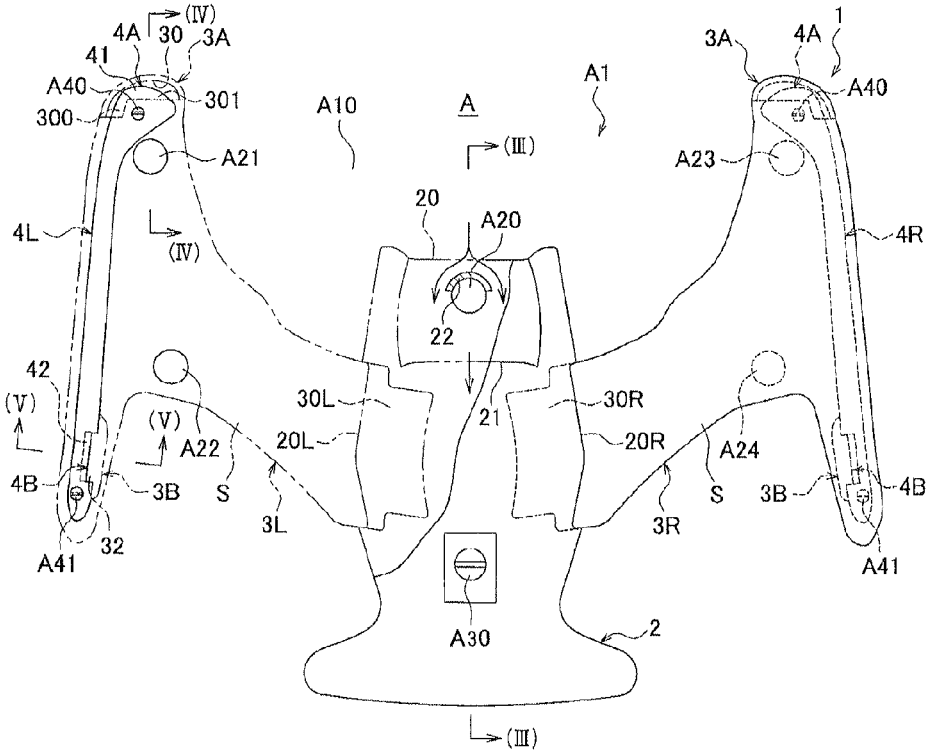
FIG. 2 is a partially cutaway principal enlarged diagram of FIG. 1.

In the present invention, desirably, the front/rear direction of movement of the left duct part and the right duct part on the outer surface, limited by the first engaging support part, is a rearward direction, and the left/right direction of movement of the left duct part and the right duct part on the outer surface, limited by the second engaging support part, is a direction away from the central duct part.

Furthermore, desirably, the first engaging support part and the second engaging support part are integrally formed.

Furthermore, desirably, an insertion length of the insertion portion which is inserted into the insertion opening is adjustable such that positions of the first engaging support part and the second engaging support part can be changed by adjusting the insertion length of the insertion portion, and an overall size of the ventilation duct combining the left duct part, the right duct part and the central duct part can be changed.

The shell described below constitutes an outermost layer of the helmet, and is molded in a full-face shape or an open-face shape, using a reinforced fiber resin (GFRP, CFRP, or the like) obtained by immersing a reinforcing fiber material (glass fibers, carbon fibers, or the like) in a thermally curable resin (epoxy resin, phenol resin, or the like), or using a thermoplastic resin material (polycarbonate, or the like).

The helmet described below includes both a full-face type helmet and an open-face type helmet, and is provided, on the inner side of the shell, with a shock absorbing liner molded using a foamed styrol material, or a material having shock absorbing properties similar to this foamed styrol material, and a head pad made from a urethane material, arranged on the inner side of the shock absorbing liner, and cheek pads, or the like, which are installed removably on the inside surfaces of the left and right side portions of the shell which correspond to the cheeks.

The terms "left" and "right" used in the description given below indicate the left/right direction following the left cheek and the right cheek of the person wearing the helmet. Furthermore, the term "front" in the description given below means the side of the face of the person wearing the helmet, and the term "rear" means the side of the back of the head of the person wearing the helmet.

The helmet A according to one embodiment of the present invention is described below on the basis of FIG. 1 to FIG. 5. The helmet A given in this example is a full-face helmet.

The present invention is not limited to the embodiments described below.

In the helmet A, a shield B is arranged on the front of a shell A1, and a ventilation duct 1 is arranged on an outer surface A10 of the shell A1 in a range from a head top part to a head rear part.

A ventilation duct 1 covers ventilating holes A20, A21, A22, A23, A24 provided so as to pass through between the inner surface A11 and the outer surface A10 of the helmet A, and also guides exhaust air to the exterior, of the helmet A, of the air circulated through the ventilating holes A20, A21, A22, A23, A24.

The ventilating hole A20 is opened in the center of the left/right direction of the shell A1, the ventilating holes A21, A22 are opened on the left side with respect to the ventilating hole A20, and the ventilating holes A23, A24 are opened on the right side with respect to the ventilating hole A20.

The ventilating holes A20, A21, A22, A23, A24 are each opened at optimal positions for performing efficient ventilation.

The ventilation duct 1 is formed of three members: a central duct part 2 which covers the ventilating hole A20; a left duct part 3L which covers the ventilating holes A21, A22; and a right duct part 3R which covers the ventilating holes A23, A24.

Formed in the central duct part 2 are, on the front end side thereof, an introduction port 20 by which external air is introduced when travelling, and to the rear side of the ventilating hole A20, an exhaust air port 21 which communicates with the introduction port 20 to the rear side. Due to a negative pressure that occurs when external air introduced from the introduction port 20 is discharged from the exhaust air port 21, hot air trapped inside the helmet A can be suctioned and also discharged from the exhaust air port 21.

The central duct part 2 is installed by being fastened to the shell A1 by a screw A30, which is one example of an installation part, and the central duct part 2 can be removed from the shell A1 by removing this screw A30.

Furthermore, on the left and right side portions of the central duct part 2 are formed insertion openings 20L, 20R into which an insertion portion 30L provided on the right end portion of the left duct portion 3L and an insertion portion 30R provided on the left end portion of the right duct part are inserted.

When the insertion portions 30L, 30R have been inserted into these insertion openings 20L, 20R, by fastening the central duct part 2 to the shell A1 by the screw A30, the insertion portions 30L, 30R of the left and right duct parts 3L, 3R are gripped by the central duct part 2 and the shell A1.

Furthermore, in the front central portion of the central duct part 2, a wall section 22 is formed so as to surround the edge of the front-side half perimeter of the ventilating hole A20, in order to raise the flow speed by dividing the flow of air entering from the introduction port 20 during travel, into two directions, thereby increasing the discharge of air from the ventilating hole A20, as well as preventing rain water from entering into the ventilating hole A20.

The left and right duct parts 3L, 3R are installed in an immobile state on the shell A1 by the engagement and support of the engaging support members 4L, 4R provided on the shell A1, and the gripping of the insertion portions 30L, 30R between the central duct part 2 and the shell A1 described above.

The distance between the engaging support members 4L, 4R and the insertion openings 20L, 20R varies with the size of the shell A1, which changes in accordance with the different sizes of the helmet A, but this variation in the distance can be taken in the amount by which the insertion portions 30L, 30R are inserted into the insertion openings 20L, 20R.

In other words, it is possible to adapt to various different sizes of the helmet A, by taking the difference in the distance in the left/right direction between the ventilating holes A21, A22 and the ventilating holes A23, A24, which varies with the size of the shell A1, which in turn changes in accordance with the different sizes of the helmet A, in the insertion amount of the insertion portions 30L, 30R into the insertion openings 20L, 20R.

Therefore, it is possible to arrange the central duct part 2, and the left and right duct parts 3L, 3R, which are each of one size, at optimal positions in accordance with the positions of the ventilating holes A21, A22 and the ventilating holes A23, A24, which vary with the different sizes of the helmet A.

Figure 3:
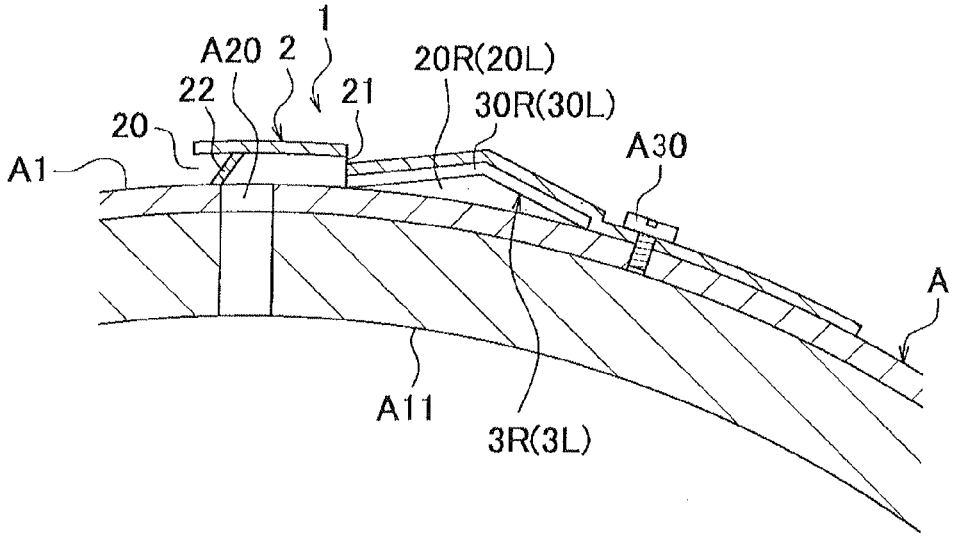
FIG. 3 is a cross-sectional diagram along line (III)-(III) in FIG. 2.
Figure 4:
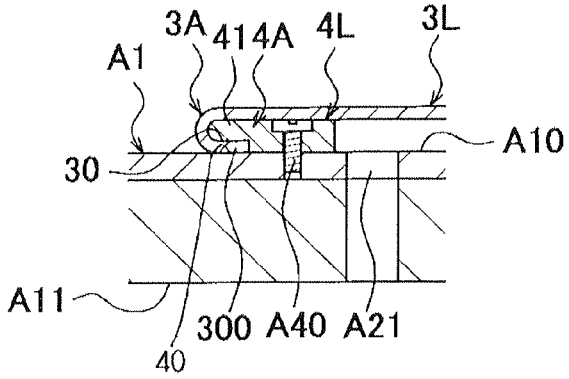
FIG. 4 is a cross-sectional diagram along line (IV)-(IV) in FIG. 2.
Figure 5:
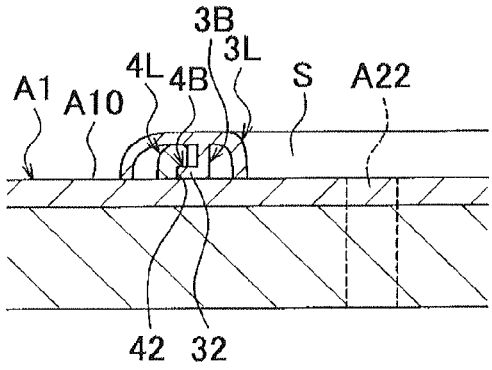
FIG. 5 is a cross-sectional diagram along line (V)-(V) in FIG. 2.

As shown in FIG. 3, the insertion portions 30L, 30R are formed in a bent shape in such a manner that the central duct part 2 and the left and right duct parts 3L, 3R communicate with each other between the insertion portions 30L, 30R and the outer surface A10 of the shell A1, the insertion openings 20L, 20R are opened in a shape that is similar to, and slightly smaller than, the shape of the insertion portions 30L, 30R, and by fastening the central duct part 2 with the screw A30, the insertion portions 30L, 30R are pressed against the outer surface A10 of the shell A1 by the insertion openings 20L, 20R, whereby the displacement of the left and right duct parts 3L, 3R in the left/right direction can be limited.

The composition of the left and right duct parts 3L, 3R and the composition of the engaging support members 4L, 4R are described here, but the left and right duct parts 3L, 3R and the engaging support members 4L, 4R have shapes having left/right symmetry with respect to the central duct part 2, and therefore the left duct part 3L and engaging support member 4L are described below, and description of the right duct part 3R and engaging support member 4R is omitted.

A first engaging part 3A which engages with a first engaging support part 4A set on the engaging support member 4L, and a second engaging part 3B which engages with a second engaging support part 4B set on the engaging support member 4L are provided on the left end portion of the left duct part 3L.

The left duct part 3L is formed in such a manner that the front end thereof makes close contact with the outer surface A10 of the shell A1, and the rear end thereof can reserve an exhaust space S between itself and the outer surface A10 of the shell A1.

The engaging support member 4L is arranged at a position whereby, at the arrangement position of the left duct part 3L, the first engaging support part 4A and the second engaging support part 4B respectively oppose and are able to engage with the first engaging part 3A and the second engaging part 3B.

Furthermore, in the engaging support member 4L, the first engaging support part 4A and the second engaging support part 4B are integrally formed in the upper/lower direction, in such a manner that the first engaging support part 4A is on the upper side and the second engaging support part 4B is on the lower side, the engaging support member 4L being installed in a fixed state on the outer surface A10 of the shell A1 by screws A40, A41.

In other words, by means of the engaging support member 4L in which the first engaging support part 4A and the second engaging support part 4B are integrally formed, when the engaging support member 4L is installed in a fixed state on the outer surface A10 of the shell A1, the first engaging support part 4A and the second engaging support part 4B can be arranged in accurate positions.

The engagement structure of the first engaging part 3A and the first engaging support part 4A, and the engagement structure of the second engaging part 3B and the second engaging support part 4B are described below.

The engagement structure of the first engaging part 3A and the first engaging support part 4A is a recess and protrusion engagement structure which can be engaged and disengaged in the front/rear direction, the recessed side being the first engaging part 3A and the protruded side being the first engaging support part 4A.

In the first engaging support part 4A, a front end side portion of the engaging support member 4L projects to the front so as to reserve an engagement space 40 which separates from the outer surface A10 of the shell A1 in the thickness direction of the shell A1, and a fitting protruded part 41 in which the front end is shaped into a circular arc shape is also formed.

A fitting recessed part 30 which is recessed on the front end side so as to fit with the fitting protruded part 41 from the front side is formed in the first engaging part 3A, and when the fitting recessed part 30 is fitted with the fitting protruded part 41, a wall surface 300 on the shell A1-side of the fitting recessed part 30 fits into the engagement space 40.

By the fitting together of the fitting protruded part 41 and the fitting recessed part 30, and the insertion of the insertion portion 30L into the insertion opening 20L described above, it is possible to limit movement of the left duct part 3L in the front/rear direction, and movement thereof in a direction away from the shell A1.

Furthermore, the fitting recessed part 30 is formed in such a manner that, when fitted with the fitting protruded part 41, the left duct part 3L rotates in the left/right direction about a center of rotation in the vicinity of the front end of the fitting protruded part 41A, which lies in contact with the fitting recessed part 30.

More specifically, the fitting recessed part 30 is formed to a shape and size whereby, when fitted with the fitting protruded part 41, a rotation space 301 can be reserved to enable the left duct part 3L to rotate in the left/right direction about the front side of the fitting protruded part 41.

A fitting protruded part 32 is formed on the second engaging part 3B that projects to the left side at the right end portion of the engaging support member 4L (the end on the side towards the central duct part 2).

A fitting recessed part 42 which is recessed to the left side is formed on the second engaging support part 4B in such a manner that the fitting protruded part 32 fits therewith from the right side, and by separating the fitting protruded part 32 in the rightward direction from the fitting recessed part 42, and also rotating the left duct part 3L in the leftward direction in a state where the fitting recessed part 30 has been fitted with the fitting protruded part 41, it is possible to fit the fitting protruded part 32 with the fitting recessed part 42.

By the fitting together of the fitting protruded part 32 and the fitting recessed part 42, and the insertion of the insertion portion 30L into the insertion opening 20L described above, it is possible to limit the movement of the left duct part 3L in the left/right direction.

By adopting a ventilation duct 1 of this kind, the central duct part 2 and the left and right duct parts 3L, 3R can be unified to create a ventilation duct 1, as well as being installed in an immobile state, by fixing the central duct part 2 to the shell A1 by the screw A30, and also inserting the insertion portion 30L of the left duct part 3L into the insertion opening 20L formed in the central duct part 2 and fitting the fitting recessed part 30 of the left duct part 3L with the fitting protruded part 32 and fitting the fitting protruded part 41 of the engaging support member 4L with the fitting recessed part 42.

Figure 6:
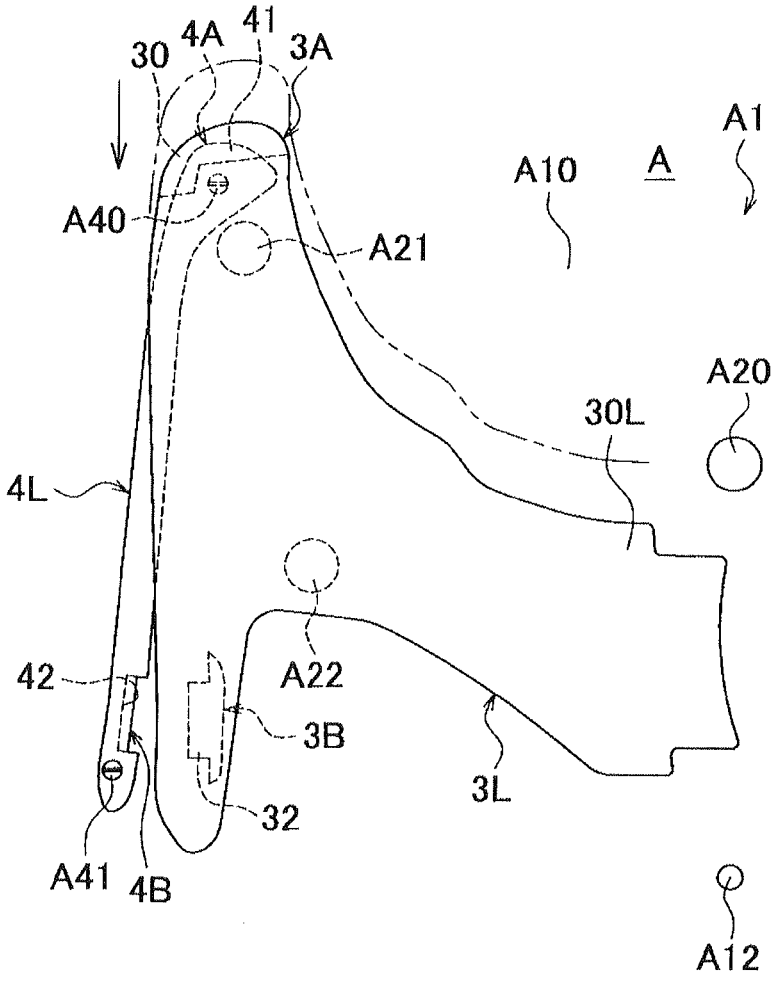
FIG. 6 is an installation step diagram for a ventilation duct, and is an illustrative diagram showing a first step.
Figure 7:
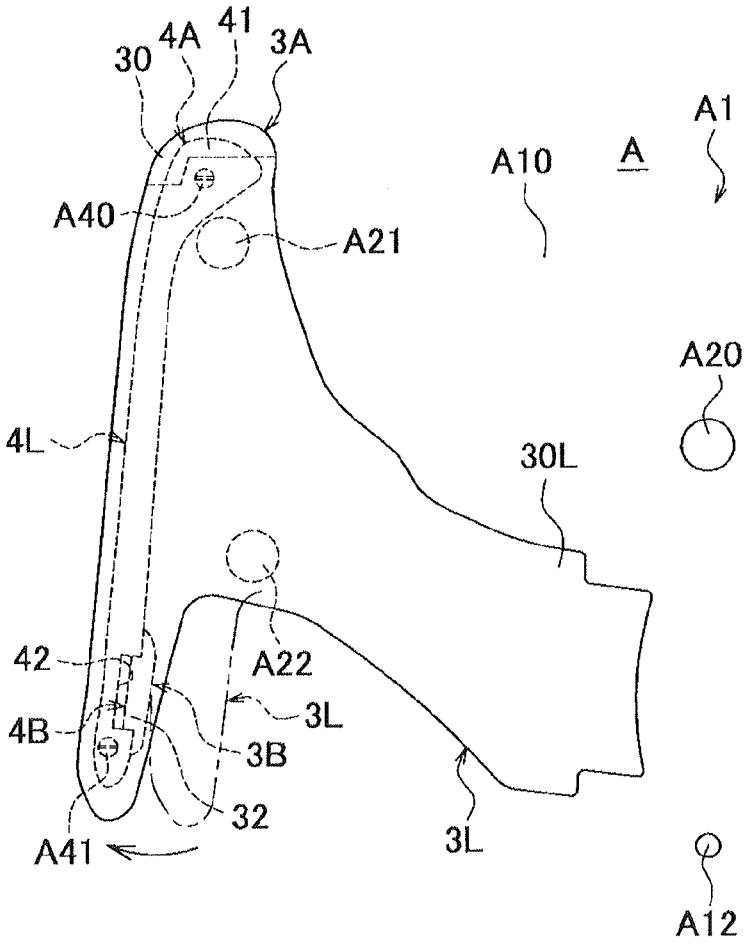
FIG. 7 is an installation step diagram for a ventilation duct and is an illustrative diagram showing a second step.
Figure 8:
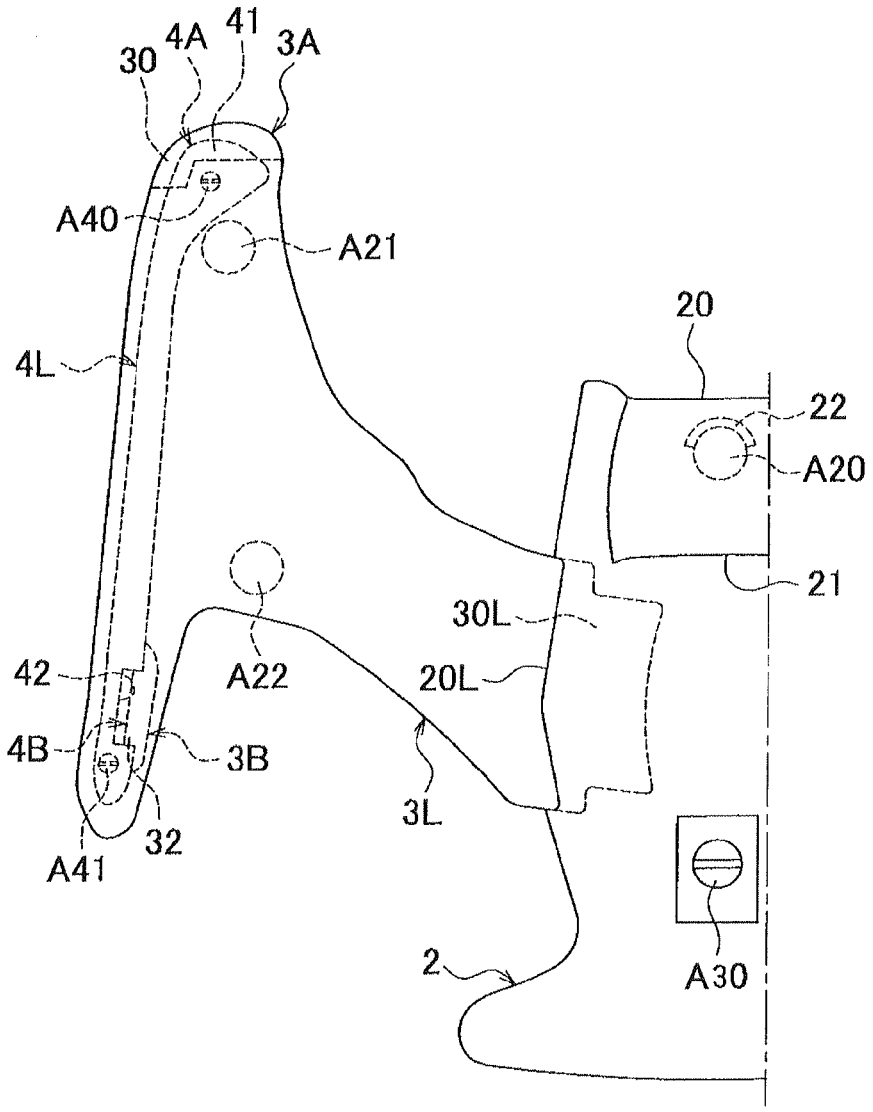
FIG. 8 is an installation step diagram for a ventilation duct and is an illustrative diagram showing a third step.

Next, the installation steps for the ventilation duct 1 will be described on the basis of FIG. 6 to FIG. 8, and here the left duct part 3L and the left half of the central duct part 2 are illustrated and described. In the drawings, reference numeral A12 is a screw hole into which the screw A30 is screwed.

First Step (FIG. 6): The fitting recessed part 30 is fitted with the fitting protruded part 41, from the front.

In so doing, the fitting protruded part 41 and the fitting recessed part 30 are fitted. together in a state where the left duct part 3L is arranged in such a manner that the fitting protruded part 32 is separated towards the side of the central duct part 2 from the fitting recessed part 42.

Second Step (FIG. 7): The left duct part 3L is rotated to the left side and the fitting protruded part 32 is fitted with the fitting recessed part 42, in a state where the fitting recessed part 30 has been fitted with the fitting protruded part 41.

This state where the fitting protruded part 32 has been fitted with the fitting recessed part 42 is the arrangement position of the left duct part 3L with respect to the outer surface A10 of the shell A1.

Third Step (FIG. 8): The central duct part 2 is arranged on the outer surface A10 of the shell A1, and is fastened by a screw A30, so as to achieve a state where the insertion portion 30L is inserted into the insertion opening 20L.

In this case, the force by which the central duct part 2 is fastened by the screw A30 acts as a force which presses the insertion portion 30L which has been inserted into the insertion opening 20L against the outer surface A10 of the shell A1, via the insertion opening 20L, and due to this force, the left duct part 3L is deformed so as to match the curved surface of the outer surface A10 of the shell A1.

In other words, by fastening the central duct part 2, it is possible to form a ventilation duct 1 in which the left duct part 3L is arranged in an immobile state at the arrangement position of the left duct part 3L with respect to the outer surface A10 of the shell A1, and is unified with the central duct part 2.

According to the helmet A described above, it is possible to provide a ventilation duct 1 which can correspond to a helmet A of various different sizes by means of a central. duct part 2 and left and right duct parts 3L, 3R of the same size, as described previously.

Consequently, since a ventilation duct 1 can be formed by a central duct part 2 and left and right duct parts 3L, 3R of the same size and shape, it is possible to reduce the molding die manufacturing costs and component management costs, and hence the manufacturing costs of the helmet A having the ventilation duct 1 can be reduced.

Furthermore, since the left and right duct parts 3L, 3R can be arranged at optimal positions in accordance with variation in the distance between the ventilating holes A21, A22 and the ventilating holes A23, A24, which changes with the different sizes of the helmet A, then it is possible to install the ventilation duct 1 accurately on the outer surface A10 of the shell A1, without reducing the ventilation efficiency of the ventilating holes A21, A22 and A23, A24.

Consequently, it is possible to provide an inexpensive helmet A having a ventilation duct 1 capable of efficient ventilation.

REFERENCE SIGNS LIST

A: helmet
A1: shell
A10: outer surface
A11: inner surface
A20: ventilating hole
A21: ventilating hole
A22: ventilating hole
A23: ventilating hole
A24: ventilating hole
A30: screw (installation part)
1: ventilation duct
2: central duct part
20L: insertion opening
20R: insertion opening
3L: left duct part
3R: right duct part
3A: first engaging part
3B: second engaging part
30L: insertion portion
30R: insertion portion
4L: engaging support member
4R: engaging support member
4A: first engaging support part
4B: second engaging support part

The invention claimed is:

1. A helmet comprising, on an outer surface of a shell constituting an outermost layer of the helmet, a ventilation duct which covers ventilating holes provided so as to pass through between an inner surface of said helmet and said outer surface and which guides air circulated through said ventilating holes;

wherein said ventilation duct comprises a left duct part and a right duct part arranged respectively on the left and right sides of said shell, and a central duct part arranged between said left duct part and said right duct part;

said left duct part and said right duct part have a structure in which said left duct part and said right duct part are held by engaging support members arranged at positions of said left duct part and said right duct part on the outer surface of said shell, and by said central duct part;

said engaging support members each comprise a first engaging support part and a second engaging support part; the first engaging support part prevents detachment of said left duct part and said right duct part from the outer surface of said shell towards an outer side in a thickness direction of said shell, and also limits at least one of movement in a front direction and movement in a rear direction of said left duct part and said right duct part on said outer surface, and the second engaging support part limits at least one of movement in a left direction and movement in a right direction of said left duct part and said right duct part on said outer surface;

said left duct part and said right duct part each comprise a first engaging part which engages with said first engaging support part, a second engaging part which engages with said second engaging support part, and an insertion portion which is inserted into an insertion opening provided in each of left and right side portions of said central duct part; and said central duct part, by being fixed to said outer surface via an installation part in a state where said insertion portions have been inserted into said insertion openings, keeps said insertion portions in the inserted state by said insertion openings and said outer surface, as well as holding the engaged state of said first engaging parts and the engaged state of said second engaging parts of said left duct part and said right duct part, and the installed state of said central duct part on said outer surface, and thereby fixing said left duct part and said right duct part to said outer surface.

2. The helmet according to claim 1, wherein the front/rear direction of movement of said left duct part and said right duct part on said outer surface, limited by said first engaging support part, is a rearward direction, and the left/right direction of movement of said left duct part and said right duct part on said outer surface, limited by said second engaging support part, is a direction away from said central duct part.

3. The helmet according to claim 1, wherein said first engaging support part and said second engaging support part are integrally formed.

4. The helmet according to claim 2, wherein said first engaging support part and said second engaging support part are integrally formed.

5. The helmet according to claim 1, wherein an insertion length of said insertion portion which is inserted into said insertion opening is adjustable such that positions of said first engaging support part and said second engaging support part can be changed by adjusting the insertion length of said insertion portion, and an overall size of said ventilation duct combining said left duct part, said right duct part and said central duct part can be changed.

6. The helmet according to claim 2, wherein an insertion length of said insertion portion which is inserted into said insertion opening is adjustable such that positions of said first engaging support part and said second engaging support part can be changed by adjusting the insertion length of said insertion portion, and an overall size of said ventilation duct combining said left duct part, said right duct part and said central duct part can be changed.

7. The helmet according to claim 3, wherein an insertion length of said insertion portion which is inserted into said insertion opening is adjustable such that positions of said first engaging support part and said second engaging support part can be changed by adjusting the insertion length of said insertion portion, and an overall size of said ventilation duct combining said left duct part, said right duct part and said central duct part can be changed.

8. The helmet according to claim 4, wherein an insertion length of said insertion portion which is inserted into said insertion opening is adjustable such that positions of said first engaging support part and said second engaging support part can be changed by adjusting the insertion length of said insertion portion, and an overall size of said ventilation duct combining said left duct part, said right duct part and said central duct part can be changed.

* * * * *